United States Patent [19]

Eisner

[11] 4,147,008

[45] Apr. 3, 1979

[54] RESILIENT REINFORCEMENT SPACER

[76] Inventor: Horst Eisner, Sauerbruchstrasse 4, Nuremberg, Fed. Rep. of Germany

[21] Appl. No.: 814,810

[22] Filed: Jul. 11, 1977

[51] Int. Cl.[2] ..... E04C 5/20

[52] U.S. Cl. ..... 52/684; 249/91; 249/210

[58] Field of Search ..... 249/30, 91, 205, 207, 249/210; 52/677–689

[56] References Cited

U.S. PATENT DOCUMENTS

| | | | |
|---|---|---|---|
| 1,356,315 | 10/1920 | Scofield et al. | 52/685 |
| 1,788,180 | 1/1931 | White | 52/677 |
| 1,946,418 | 2/1934 | Welch | 52/684 |

FOREIGN PATENT DOCUMENTS

| | | | |
|---|---|---|---|
| 152097 | 10/1955 | Sweden | 52/684 |

*Primary Examiner*—Richard B. Lazarus
*Assistant Examiner*—John McQuade
*Attorney, Agent, or Firm*—Karl W. Flocks

[57] ABSTRACT

A spacer for concrete reinforcements, comprising a moulded member and two ends of a wire stirrup projecting therefrom, the curved connecting part of the stirrup being anchored in the moulded member and the intersecting ends of the resilient wire stirrup being bent towards one another to clip on the reinforcements rod by turning the spacer.

10 Claims, 6 Drawing Figures

RESILIENT REINFORCEMENT SPACER

The invention relates to a spacer, more particularly for securing to reinforcements for reinforced concrete, comprising a moulded member and two ends of a wire stirrup projecting therefrom, the curved connecting part of the stirrup being anchored in the moulded member.

In the case of a known moulded member of the aforementioned kind, made of conrete and having wire anchored therein, the spacer is secured to a reinforcement by winding the projecting wire ends around the reinforcement and twisting the wires together. In this manner, a reinforcing mat is provided with a sufficient number of such spacers and, with the spacers facing downward, is placed on the formwork, so that the mat is held at a distance from the formwork and can be completely surrounded with concrete.

An object of the invention is to construct a spacer of the aforementioned kind so that it can easily and rapidly be secured to a bar, e.g. a reinforcement or the like, and remains fixed in the position in which it is secured.

To this end, according to the invention, the ends of the wire stirrup, which is made of resilient material, are bent towards one another and intersect. According to an advantageous embodiment of the invention, the inner angle between the wire ends and to surface of the moulded member is less than 60°.

According to another advantageous feature, in order to ensure that the spacer can be used for rods having a variety of different diameters or cross-sections, the distance of the wires from the surface of the moulded member is at least three times as great as the smallest diameter and at most twice as great as the largest diameter or cross-section of an at least approximately square or round bar, to be held in spaced relationship. If, for example, the wire spacing is 3 cm and the internal angle is approx. 40°, the spacer can be rapidly and permanently secured to rods having a diameter between approximate 8 and 18 cm, by placing it on the rods and twisting it.

Other advantageous details of the invention will be described with reference to the embodiments shown in the drawings, in which:

FIG. 1 shows a moulded member 1 of concrete or another suitable material, e.g. plastics, in which a wire stirrup 2 is embedded, the stirrup being made more particularly of spring steel, the curved portion and part of the projecting ends being embedded.

Figure 1:
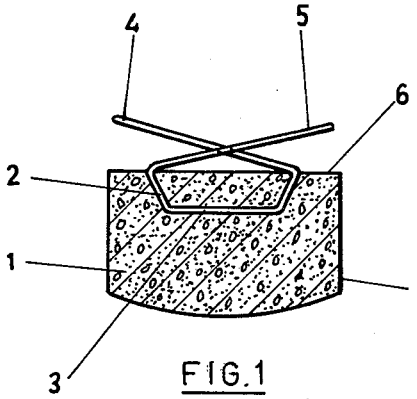
FIG. 1 is a side sectional view of a spacer according to the invention.

According to the invention, the projecting wire ends 4, 5 are bent in opposite directions, so that they intersect and include an angle less than 60°, preferably less than 5–15°, with the surface 6 of moulded member 1. They are given a length such that spacer 7 can easily be placed on a rod 8, more particularly a reinforcement, e.g. of a reinforcing mat, and the spacer can be secured to rod 8 by rotating the spacer about 180° around its longitudinal axis.

Figure 2:
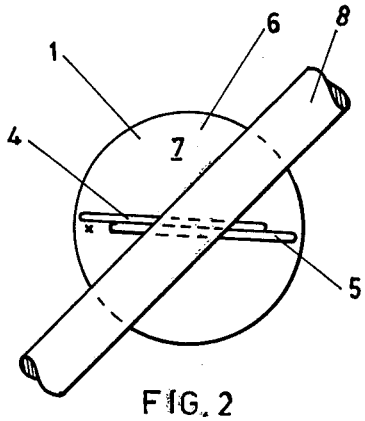
FIG. 2 shows the spacer from above.
Figure 3:
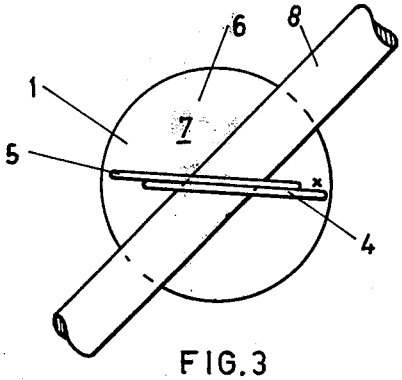
FIG. 3 shows the spacer from above after it has been secured to a rod.

This process is shown in FIGS. 2 and 3. In FIG. 2, a rod 8 lies in a fork formed by the intersecting wire ends 4 and 5. When spacer 7 is rotated, ends 4 and 5 are resiliently bent apart and, as a result of their resilient action and inclined position with respect to surface 6, the spacer snaps on to rod 8. When it is further rotated, it becomes secured to rod 8 by the frictional contact between surface 6 and rod 8 on the one hand and between rod 8 and wire ends 4, 5 and their resilient action on the other hand. This final state is shown in FIG. 3.

Figure 4:
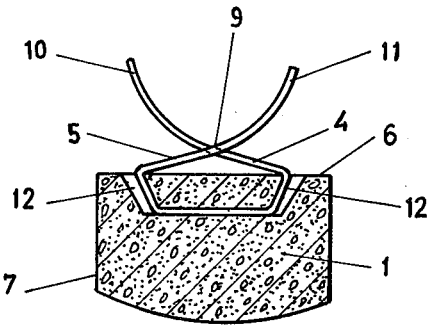
FIG. 4 is a sectional side view of a spacer according to the invention having specially shaped wire ends.
Figure 5:
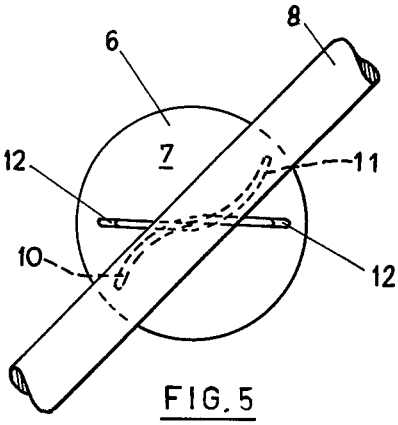
FIG. 5 is a top view of the spacer in FIG. 4.
Figure 6:
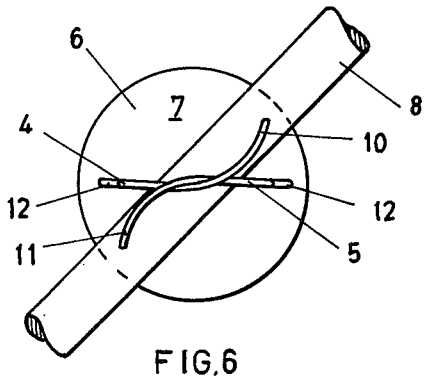
FIG. 6 is a top view of the last-mentioned spacer after it has been secured to a rod.

An advantageous further embodiment of the invention is shown in FIGS. 4–6. In this embodiment, ends 4 and 5, substantially at the point of intersection 9, are formed into a curve 10, 11, e.g. a quarter-circle, so that curves 10, 11 project in the interlacing direction from the plane clamped by the wire stirrup. Consequently, when spacer 7 is rotated on rod 8, curves 10, 11 interlace and produce a closing force which pulls member 1 against rod 8. Consequently, spacer 7 is very efficiently secured to rod 8, as a result of the special shaping of ends 4 and 5.

The spacer can be used for all kinds or rods, bars, bar portions or the like having a suitable cross-section, e.g. also when parts are embedded in plastics, in which case use can be made of plastics rods or a plastics lattice of rods and spacers, using a plastics moulded member.

In an advantageous embodiment of the invention, moulded member 1 has a recess 12 extending outwardly in the direction of the outerwards bent portions of the ends 4, 5 and extending from surface 6 inwardly towards stirrup 3. The width of recess 12 is at least equal to the wire diameter. This prevents parts of member 1 breaking off when ends 4, 5 are bent outwards. Preferably, recesses 12 are in the form of slots.

I claim:

1. A spacer for attachment to a reinforcing element for reinforced concrete comprising a moulded member, a stirrup of resilient wire having a base portion embedded in said moulded member, and two protruding wire ends extending from the upper surface of the moulded member in the direction of each other with an acute angle between said protruding ends and said surface, with said wire ends intersecting each other above said surface and spaced for clamping the reinforcing element between the protruding ends and the surface of the moulded member by placing the free ends of said protruding wire end beyond the intersection point astraddle of the reinforcing element and forcing the spacer down to it while turning the spacer substantially 180° about an axis through the point of intersection of said protruding wire ends.

2. A spacer according to claim 1, wherein at least respective end portions of said wire ends are curved in opposite directions relative to a general vertical plane containing said stirrup, said ends bent for passing each other so as to partly entwine at the point of intersection.

3. A spacer according to claim 2, characterised in that the curves (10, 11) begin at the point of intersection (9) of the wire ends (4, 5).

4. A spacer according to claim 3, characterised in that each of the curves (10, 11) form a quarter-circle.

5. A spacer according to, claim 1 characterised in that the wire ends (4, 5) form an angle of less than 60° with the surface (6) of the moulded member (1).

6. A spacer according to claim 5, characterised in that the angle is less than 15°.

7. A spacer according to clam 1 characterised in that the moulded member is made of concrete.

8. A spacer according to claim 1 characterised in that the wire stirrup (2) is made of spring steel.

9. A spacer according to claim 1 characterised in that in the region of the stirrup portions which extend form the moulded member (1), the moulded member has an inwardly extending recess (12).

10. A spacer according to claim 9, characterised in that the recess (12) is slot-shaped.

* * * * *